United States Patent [19]

Johnson

[11] 4,246,855

[45] Jan. 27, 1981

[54] COMPENSATING NEEDLE BAR CONNECTING LINKAGE FOR A SEWING MACHINE

[75] Inventor: Ralph E. Johnson, Convent Station, N.J.

[73] Assignee: The Singer Company, Stamford, Conn.

[21] Appl. No.: 49,679

[22] Filed: Jun. 18, 1979

[51] Int. Cl.[3] ..... D05B 3/02; D05B 55/14

[52] U.S. Cl. ..... 112/158 R; 112/221

[58] Field of Search ..... 112/158 R, 181, 184, 112/221

[56] References Cited

U.S. PATENT DOCUMENTS

| | | | |
|---|---|---|---|
| 2,662,495 | 12/1953 | Parry | 112/158 R |
| 2,932,268 | 4/1960 | Johnson | 112/221 |
| 3,026,831 | 3/1962 | Johnson | 112/158 R |
| 3,040,682 | 6/1962 | Leslie | 112/221 |
| 3,148,646 | 9/1964 | Sigoda | 112/158 R |
| 3,318,272 | 5/1967 | Taketomi | 112/158 R |

FOREIGN PATENT DOCUMENTS

| | | | |
|---|---|---|---|
| 46-8856 | 3/1971 | Japan . | |
| 206296 | 6/1968 | U.S.S.R. | 112/221 |

*Primary Examiner*—Wm. Carter Reynolds
*Attorney, Agent, or Firm*—William V. Ebs; Robert E. Smith; Edward L. Bell

[57] ABSTRACT

A zig-zag sewing machine is provided with a compensating link and slide which engage on curved surfaces extending in a circular arc that has its center in line with the link. The compensating link and slide are situated between a crank and needle bar and move relative to each other during zig-zag operations to modify the operating effect of the crank and cause a needle to be similarly positioned relative to a vertical axis hook for loop taking in alternate zig-zag positions of the needle bar.

9 Claims, 7 Drawing Figures

COMPENSATING NEEDLE BAR CONNECTING LINKAGE FOR A SEWING MACHINE

BACKGROUND OF THE INVENTION

1. Field of the Invention

The invention relates to zig-zag sewing machines and is particularly directed to needle bar drive mechanism therefor.

2. Description of the Prior Art

During stitch formation in a sewing machine the needle bar is reciprocated endwise to penetrate the work and from the point of maximum penetration, it rises to throw a loop on the underside of the work that is then entered by the loop seizing beak of a hook. There is an optimum delay, such as twenty degrees of arm shaft rotation, between the time the needle reaches the point of maximum penetration and the time that the beak enters the loop which is calculated to produce a needle thread loop that is sufficiently large to insure loop seizure and to position the eye of the needle in a specific relationship to the loop seizing beak for the proper presentation of the loop to the loop seizing beak.

In straight-stitch machines timing of the needle relative to the hook for proper loop taking doesn't present a problem. However, in zig-zag sewing machines the optimum timing relationship is effected by lateral movement of the needle. When the needle is moved in one direction, loop seizure is retarded by the amount of time required for the loop taker to travel from the previous position of loop seizure to the new position of loop seizure. Since the needle bar continues to rise during the time that the loop taker is traveling to the new position, the optimum timing relationship is destroyed, or more specifically, the eye of the needle is too high. Conversely, when the needle is moved in the other direction, loop seizure is advanced with the result that the eye of the needle is too low.

One approach to the timing problem in zig-zag machines is to time the needle relative to the hook so as to obtain the optimum relationship in the zero bight position, or in other words in a position in the center of the zig-zag pattern. The effects of the variations in the time of loop seizure are thereby minimized. Nevertheless, variations from the optimum timing relationship during zig-zag operations result in skipped stitches due to failure of the hook to seize the loop, and also result in thread breakage because of fouling of the loop.

Another approach to the timing problem is to provide a needle drive which compensates during zig-zag operations for variations in the timing of the needle relative to the hook in such a way as to cause the needle to be disposed at the optimum height relative to the hook for loop seizure in zig-zag positions of the needle. Compensating linkage arrangements have been proposed for such purpose but have proved to be unsatisfactory because of accompanying force components which interfered with proper operation of the gate serving to move the needle into zig-zag positions, and caused undue wear on parts of the needle drive mechanism. An example of a prior art compensating linkage arrangement is disclosed in U.S. Pat. No. 2,932,268 of The Singer Company for "Needle Bar Drives For Zig-Zag Sewing Machines" issued Apr. 12, 1960.

It is a prime object of this invention to provide the needle drive of a zig-zag sewing machine with a linkage arrangement which is effective to cause a needle to be properly positioned for loop seizing in zig-zag positions of the needle and which operates without causing undesirable forces to be applied to the gate of the machine or to parts of the needle drive mechanism.

SUMMARY OF THE INVENTION

In accordance with the invention, the drive for imparting endwise reciprocatory motion to a needle in the gate of a zig-zag sewing machine is provided with a compensating drive link and slide which engage on curved surfaces extending in a circular arc that has its center in line with the link. The compensating link and slide are situated between a crank and needle bar and move relative to each other during zig-zag motion of the gate to modify the effect of motion of the crank on the sewing needle in such fashion that the needle is similarly positioned in a proper relationship relative to a vertical axis hook for loop taking in alternate zig-zag positions of the gate. Driving forces applied during the operation of the crank to the compensating link and slide, and the associated reactive forces extend through the center of the circular arc defined by the engaging surfaces of the link and slide, and are therefor always perpendicular to said curved surfaces. Consequently they do not generate undesirable force components extending in the direction of the slide or engaging surface of the compensating link.

DESCRIPTION OF THE PREFERRED EMBODIMENT

Figure 2:
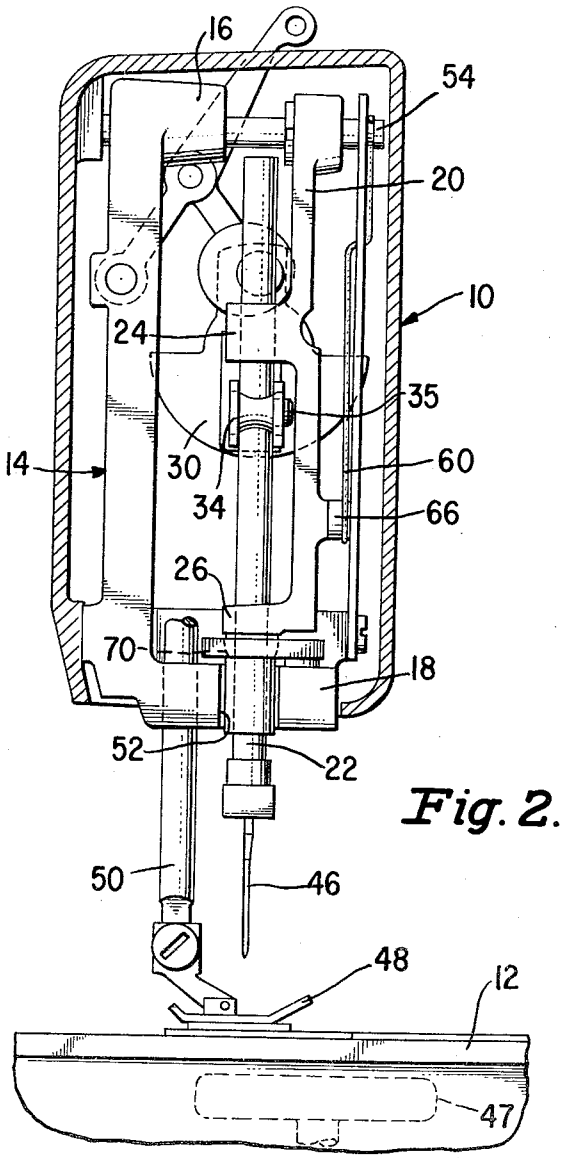
FIG. 2 is an end elevational view partially in section and with the covers removed of the head end portion of the machine of FIG. 1.

Referring to the drawings, reference characters 10 and 12 designate, respectively, the head end portion of the bracket arm and the work supporting bed portion of a sewing machine incorporating needle driving mechanism according to the invention. The head end portion 10 of the bracket arm includes a fixed support bracket 14 having an upper extending arm 16 and a lower extending arm 18 which support a needle bar gate 20.

A needle bar 22 is supported at 24 and 26 in gate 20 for endwise reciprocation by a rotating arm shaft 28 acting through a counterbalanced crank 30, a connecting drive link 32, and finally a collar 34 which is pivotally connected at screw 35 to the needle bar. Crank 30 drives one end of the needle bar connecting drive link 32 through an actuating crank pin 36. The needle bar connecting drive link 32 includes a track 38 between an upper wedge 40 and lower ledge 42, and in the track there is carried a slide 44. The slide is connected by a screw 43 to one end of a pin 45 having the needle collar 34 as an integral part thereof at the opposite end. A sewing needle 46 is carried by the lower end portion of the needle bar 22 and cooperates with a rotary loop taker hook 47 journalled in the bed portion 12 and driven by means, not shown, in timed relationship to the arm shaft 28 for concatenating the needle thread, not shown, for stitch formation.

Figure 1:
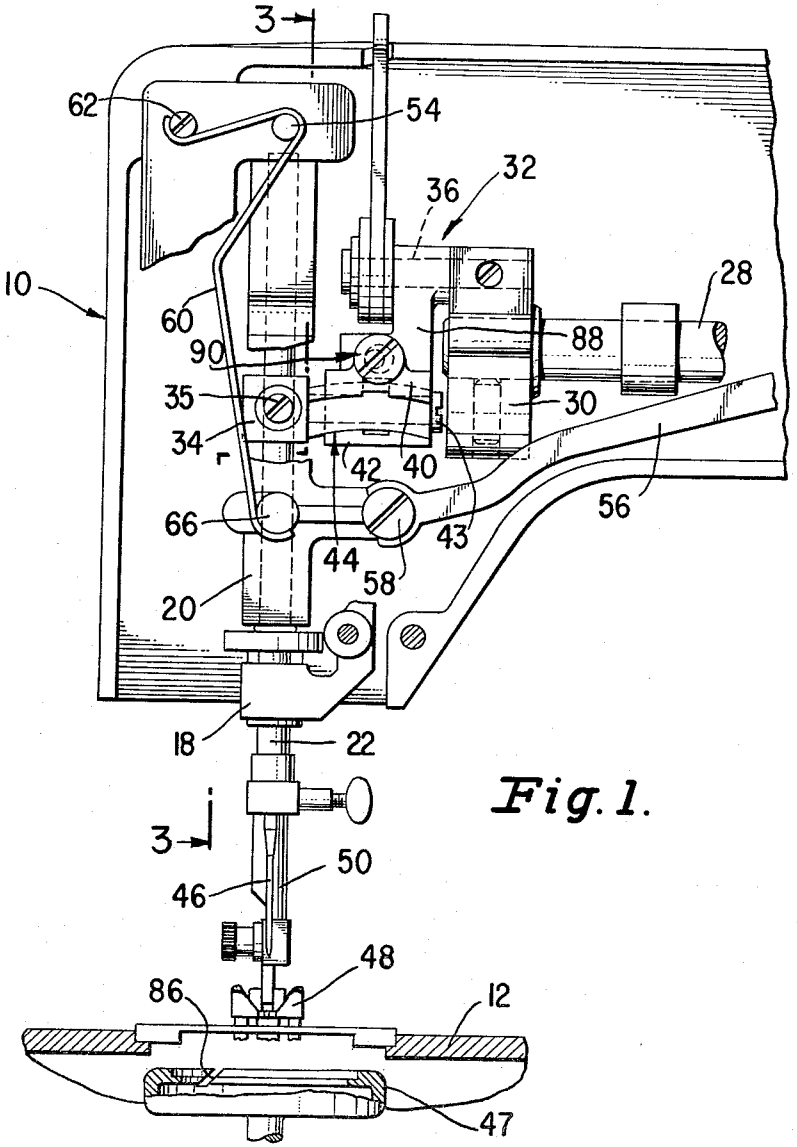
FIG. 1 is a front elevational view of the head end portion of a sewing machine with the covers removed and partially broken away to show motion compensating mechanism of the invention included therein.

A presser foot 48, affixed to a presser bar 50, is utilized to urge fabric into contact with the feeding mechanism (not shown) in the bed portion 12 of the machine. The needle bar 22 extends through an elliptical opening 52 in the arm 18 of the fixed bracket 14, which opening is sufficient size to permit zig-zag movements of the needle bar 22 in response to reciprocatory actuation of the gate 20 by needle bight control means causing the gate to pivot at its upper end on a shaft 54. Substantially any desired needle bight control means may be utilized, but preferably such control means is similar to that disclosed in U.S. Pat. No.4,188,895 of The Singer Company for "Needle Bight Control Mechanism" issued Feb. 19, 1980, and incorporated herein by reference as fully and completely as if reproduced hereat which, as shown, includes an actuating link 56 pivotally connected to the gate 20 by a fulcrum screw 58, and a return spring 60 having one end restrained by a screw 62 and an intermediate portion partially wrapped about the shaft 54, the screw 62 and shaft 54 defining fixed locations in the bracket arm head end portion 10 fixedly positioning the spring relative thereto. The other end of the spring 60 is in engagement with an abutment 66 on gate 20 urging the gate to the right as viewed in FIG. 1.

Figure 3:
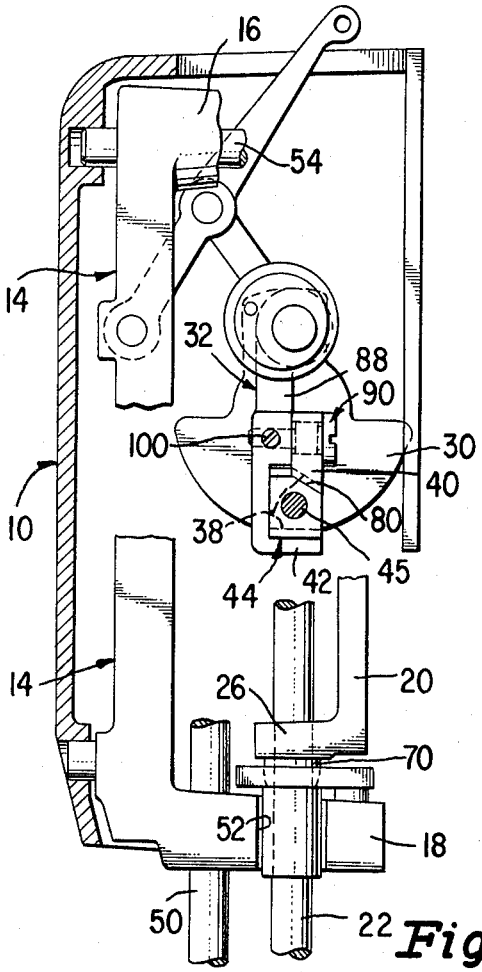
FIG. 3 is a view taken substantially on the plane of the line 3—3 of FIG. 1.
Figure 5:
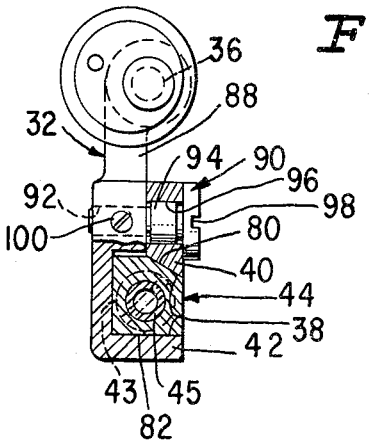
FIG. 5 is a sectional view taken on the plane of the line 5—5 of FIG. 4.
Figure 6:
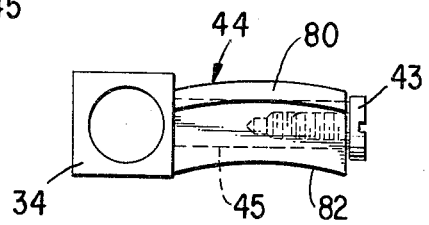
FIG. 6 is an enlarged front elevational view showing the movable slide of the mechanism of the invention.

The needle bar 22 is supported between the lower end of the gate 20 and the arm 18 of the fixed bracket 14, in the sleeve of a spherical bearing 70 (see FIGS. 2 and 3). Further details of the needle bar suspension means are disclosed in my co-pending application Ser. No. 915,084 filed June 12, 1978, now U.S. Pat. No. 4,215,638, assigned to the assignee of the present application, and hereby incorporated by reference herein as fully and completely as if reproduced hereat.

In accordance with the invention, drive link 32 and slide 44 are formed with mutually engaging curved surfaces. Link 32 is provided on wedge 40 with inclined curved surface portions **72*a* and 72*b* having a recess 74 therebetween, and is further provided with curved surface portions 76*a* and 76*b* which are separated by a recess 78 that is opposite the recess 74. The surfaces 72*a* and 72*b* define one side of the track 38 and the surfaces 76*a* and 76*b* define the other side of the track. Slide 44, which is preferably in block form as shown, is formed with an inclined curved surface 80 that engages the surfaces 72*a* and 72*b*, and with another curved surface 82 that engages the curved surface portions 76*a* and 76*b* of the link. The mutually engaging surfaces of the link and slide extend in circular arcs having a common center and enable the slide block 44 to move in track 38 during zig-zag motion of gate 20**.

As noted hereinbefore, crank 30 drives link 32 through an actuating crank pin 36. Link 32 is reciprocated in a front to rear vertical plane extending through the center of and perpendicular to the circular arcs defined by the mutually engaging surfaces of the link and slide, and acts through slide 44 to drive collar 34. The collar imparts endwise reciprocatory motion to needle bar 22 and needle 46. With the needle 46 in a central straight stitching position as illustrated in full lines in FIG. 7, the eye 84 of the needle is positioned, as is conventional, in an optimum relation relative to the beak 86 of hook 47 for loop seizure. However, when the gate 20 is pivoted to shift needle bar 22 and needle 46 laterally to the right into the position illustrated in broken lines in FIG. 7, loop seizure must occur sooner than in the full line position because beak 86 arrives at the loop seizing position sooner, and without means, such as provided in accordance with the invention, to compensate for the changed timing relationship, the needle eye 84 would be too low relative to beak 86 due to insufficient time for it to rise to the optimum loop taking position. The compensating arrangement of the invention provides for movement of the slide block 44 into the link 32 on track 38 when the needle is moved to the right, and the needle bar is raised by the slide 44 an amount determined by the curvature of the mutually engaging surfaces of the link and slide for which a radius is predetermined as required to cause the eye to be disposed in the optimum positon for loop seizure.

Figure 7:
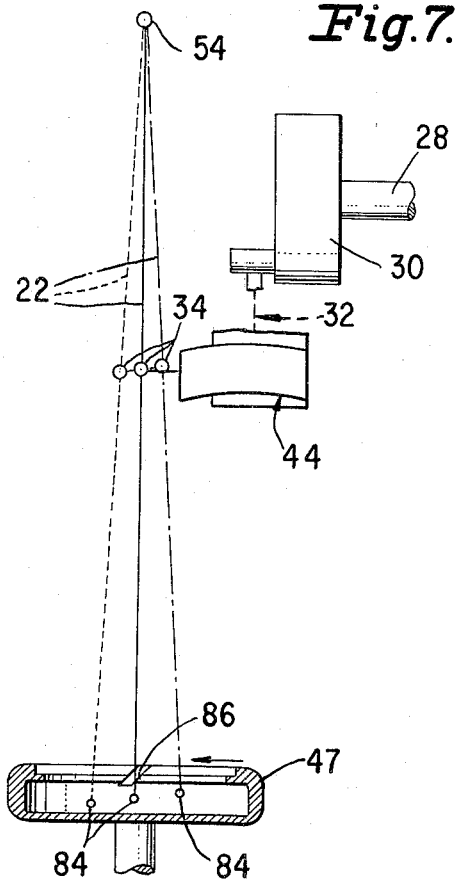
FIG. 7 is a schematic view illustrating alternate zig-zag positions of a needle in a sewing machine including the motion compensating mechanism of the invention.
Figure 4:
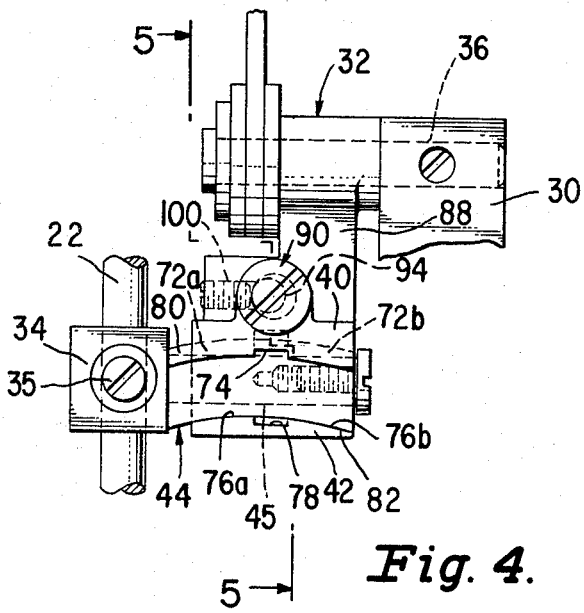
FIG. 4 is an enlarged front elevational view of the linkage mechanism of the invention.

When the needle 46 is swung by gate 20 to the left hand position illustrated in dotted lines in FIG. 7, loop seizure must occur later than when the needle is centrally located and in the absence of motion compensating mechanism, the needle would be too high by an amount defined by the continued needle bar rise as the beak 86 moved the additional distance to the new position of loop seizure. With the compensating arrangement of the invention, however, the slide 44 is caused to move to the left in link 32 as the needle is swung to the left and causes the needle bar 22 and needle 46 to be lowered so as to dispose the needle eye 84 in the optimum position for loop seizing.

With the described motion compensating arrangement, upwardly acting endwise forces, experienced by the needle as work is sewn, are transmitted to the link in directions which are substantially radially with respect to the center of the circular arcs defined by the engaging surfaces of the link and slide, and the resultant of such forces extends through such center in a front to rear vertical plane. There are substantailly no force components transmitted laterally to the link 32 tending to move the link sideways and no reactive forces components impressed by the link on the slide tending to move the slide in the link. As a consequence, simplified bearings may be used in the drive train for link 32 and power requirements both for driving the link 32 and gate 20 are minimized.

Not only is there little or no tendency for the slide 44 to be moved in link 32 by the upwardly acting endwise forces on needle 46, but such endwise forces transmitted to collar 34 and acting in conjunction with reactive normal forces exerted against the slide by the link create a force couple which serves to lock the slide 44 in link 32 while the needle 46 is in the work. Zig-zag movements of the gate occur as usual when the needle is out of the work and, at such time, the force couple is no longer present so the slide can then be freely moved by the gate.

Wedge 40 is a removably secured piece attached to link arm 88 with a pin 90 that extends through the wedge and enters a hole 92 in arm 88. The pin 90 includes an eccentric boss 94 positionable in a hole 96 in wedge 40 for adjusting the wedge to thereby tighten or loosen slide block 44 in track 38 to the degree required for controlled sliding action of the slide block in link 32 with surfaces **72*a* and 72*b* on the wedge in contact with surface 80 on the slide block and with surface 82 on the slide block in contact with surfaces 76***a* and 76*b* on the link. Once the wedge has been suitably adjusted with pin 90 as by a screw driven in slot 98, the pin can be locked in position with a set screw 100. Dislodgement of the slide 44 form link 32 is effectively prevented by the inclined surface portions 72*a* and 72*b* on the wedge. Recesses 74 and 78 in the wedge 40 and link 32 respectively reduce frictional forces between the link and slide block, and serve to prevent the slide block from binding in the link during zig-zag movements of the needle bar by the gate.

While only a particular preferred embodiment of the invention has been shown and described by way of illustration, many modifications will occur to those skilled in the art, and it is to be understood that it is intended to cover all changes and modifications falling within the true spirit and scope of the invention as set forth in the annexed claims.

I claim:

1. In a sewing machine, a needle bar for imparting endwise reciprocating motion to a sewing needle, a vertical axis hook rotatable in timed relation to endwise reciprocation of the needle, a pivotally mounted gate wherein the needle bar is mounted for endwise reciprocation, mechanism for imparting zig-zag movement to the gate and thereby to the needle, and mechanism for reciprocating the needle bar endwise in the gate including a collar connected to the needle bar, a slide located to one side of the needle bar connected to the collar, a link connected to said slide at mutually engaging surfaces which contact along concentric circular arcs and permit the slide to move on the link during zig-zag movements of the gate, and cranking means for reciprocating the link in a vertical plane extending through the center of and perpendicular to said circular arcs for causing endwise reciprocatory needle bar motion as modified by movement of the slide on the link during zig-zag motion of the gate to be imparted to the needle bar such that the needle is similarly positioned relative to the hook for loop taking in alternate zig-zag positions of the needle bar.

2. The combination of claim 1 wherein the collar is below the pivotal axis of the gate.

3. The combination of claim 2 wherein the mutually engaging surfaces on the slide and link curve downwardly in said circular arcs.

4. The combination of claim 1 wherein the slide engaging surfaces on the link define a track, and the slide is movable in said track.

5. The combination of claim 4 wherein each side of the track includes a recess between slide engaging surface portions and the recesses in the two sides of the track are directly opposite each other.

6. The combination of claim 4 wherein the slide is generally rectangular in cross-section.

7. The combination of claim 1 wherein the link includes a removably secured piece for maintaining the slide in the link.

8. The combination of claim 7 wherein the removable secured piece includes a slide engaging surface.

9. The combination of claim 8 wherein said slide engaging surface on the removably secured piece is inclined, and a link engaging surface is correspondingly inclined to engage the inclined surface on the removably secured piece.

* * * * *